US009987678B2

(12) United States Patent
Lim et al.

(10) Patent No.: US 9,987,678 B2
(45) Date of Patent: Jun. 5, 2018

(54) DIE CASTING MACHINE SHOT SLEEVE WITH POUR LINER

(71) Applicant: United Technologies Corporation, Farmington, CT (US)

(72) Inventors: Yuan Kwang Lim, Singapore (SG); Yan Seng Loh, Singapore (SG); Andrew Tan, Singapore (SG); Yao Hui Chee, Singapore (SG); Shih Han Wong, Singapore (SG); Yee Ling Kwan, Singapore (SG)

( * ) Notice: Subject to any disclaimer, the term of this patent is extended or adjusted under 35 U.S.C. 154(b) by 0 days. days.

(21) Appl. No.: 15/035,294

(22) PCT Filed: Aug. 5, 2014

(86) PCT No.: PCT/SG2014/000372
§ 371 (c)(1),
(2) Date: May 9, 2016

(87) PCT Pub. No.: WO2015/076749
PCT Pub. Date: May 28, 2015

(65) Prior Publication Data

US 2016/0279702 A1 Sep. 29, 2016

(30) Foreign Application Priority Data

Nov. 25, 2013 (SG) ..... 201308738

(51) Int. Cl.
*B22D 17/20* (2006.01)

(52) U.S. Cl.
CPC ..... *B22D 17/2023* (2013.01); *B22D 17/2038* (2013.01)

(58) Field of Classification Search
CPC ..... B22D 17/2038; B22D 17/2023
See application file for complete search history.

(56) References Cited

U.S. PATENT DOCUMENTS

| | | | |
|---|---|---|---|
| 3,516,480 | A | 6/1970 | Woltering |
| 3,735,476 | A | 5/1973 | Deribas et al. |
| 4,086,953 | A | 5/1978 | Kraklau |
| 4,926,926 | A | 5/1990 | Zecman |
| 5,012,856 | A | 5/1991 | Zecman |

(Continued)

FOREIGN PATENT DOCUMENTS

| | | |
|---|---|---|
| DE | 4302157 | 7/1994 |
| DE | 19856971 | 6/2000 |

(Continued)

OTHER PUBLICATIONS

International Preliminary Report on Patentabililty for PCT Application No. PCT/SG2014/000372, dated Jun. 9, 2016.

(Continued)

*Primary Examiner* — Kevin P Kerns
*Assistant Examiner* — Steven S Ha
(74) *Attorney, Agent, or Firm* — Carlson, Gaskey & Olds, P.C.

(57) ABSTRACT

A shot sleeve for a die casting machine includes a shot sleeve body with a pour opening that extends to a spaced apart inner and outer diameters. The shot sleeve body is a first material. A liner is secured to the shot sleeve body beneath the pour opening. The liner is a second material. The shot sleeve body and the liner together provide a plunger surface defining a cavity that is configured to receive a molten shot of material.

15 Claims, 1 Drawing Sheet

(56) References Cited

U.S. PATENT DOCUMENTS

| | | | |
|---|---|---|---|
| 5,322,111 | A | 6/1994 | Hansma |
| 5,611,477 | A | 3/1997 | Wang |
| 6,378,597 | B1 | 4/2002 | Zecman |
| 6,425,434 | B1 | 7/2002 | Muller |
| 6,470,550 | B1 | 10/2002 | Kowalczyk et al. |
| 2007/0187061 | A1 | 8/2007 | Siddle et al. |
| 2011/0011900 | A1 | 1/2011 | Fischer |

FOREIGN PATENT DOCUMENTS

| | | |
|---|---|---|
| EP | 1013363 | 12/1999 |
| WO | 9638278 | 12/1996 |
| WO | 2009079782 | 7/2009 |

OTHER PUBLICATIONS

International Search Report for International Application No. PCT/SG2014/000372 dated Nov. 10, 2014.

The Extended European Search Report for EP Application No. 14863576.6, dated Jul. 17, 2017.

DIE CASTING MACHINE SHOT SLEEVE WITH POUR LINER

BACKGROUND

This disclosure relates to a die casting machine and, more particularly, a liner for a shot sleeve.

A typical die casting machine includes a shot sleeve having a pour opening that receives molten metal. A plunger moves axially within a cavity provided by the shot sleeve to force the molten metal into a die providing a component shape.

Occasionally, the impinging molten metal locally solidifies to the shot sleeve immediately beneath the pour opening. After the plunger pushes the molten metal into the die, the thin layer of semi-solidified material provides a hardened mass adhered to the shot sleeve that may impede plunger retraction. The hardened mass can accelerate wear on the plunger and over time may cause the plunger to jam within the shot sleeve.

SUMMARY

In one exemplary embodiment, a shot sleeve for a die casting machine includes a shot sleeve body with a pour opening that extends to a spaced apart inner and outer diameters. The shot sleeve body is a first material. A liner is secured to the shot sleeve body beneath the pour opening. The liner is a second material. The shot sleeve body and the liner together provide a plunger surface defining a cavity that is configured to receive a molten shot of material.

In a further embodiment of the above, the shot sleeve body extends a first axial length. The liner extends a second axial length that is less than the first axial length.

In a further embodiment of any of the above, the plunger surface is circular and circumscribes the cavity. The liner is arcuate in shape.

In a further embodiment of any of the above, the liner is configured to extend at least to a level of a shot of molten material.

In a further embodiment of any of the above, the liner is received within a pocket in the shot sleeve body defined by an edge. The liner includes a perimeter secured to the edge by a weld.

In a further embodiment of any of the above, the liner and the weld include a machined surface that provides a portion of the plunger surface.

In a further embodiment of any of the above, the shot sleeve body includes cooling holes that are configured to be in fluid communication with a cooling fluid source. At least one cooling hole is arranged beneath the liner.

In a further embodiment of any of the above, at least one cooling hole includes a cooling channel that is in fluid communication with a backside of the liner.

In a further embodiment of any of the above, the first and second materials are different than one another.

In another exemplary embodiment, a method of manufacturing a shot sleeve includes the steps of providing a shot sleeve body with a pour opening that is in fluid communication with a cavity configured to receive a molten shot of material and securing a liner to the shot sleeve body within the cavity and beneath the pour opening. The liner, the shot sleeve body and the liner together provide a plunger surface.

In a further embodiment of the above, the method includes the steps of arranging the liner within a pocket provided in the shot sleeve body.

In a further embodiment of any of the above, the securing step includes welding a perimeter of the liner to an edge of the pocket.

In a further embodiment of any of the above, the shot sleeve body extends a first axial length. The liner extends a second axial length that is less than the first axial length.

In a further embodiment of any of the above, the plunger surface is circular and circumscribes the cavity. The liner is arcuate in shape.

In a further embodiment of any of the above, the liner is configured to extend at least to a level of a shot of molten material.

In a further embodiment of any of the above, the liner includes an unmachined surface proud of shot sleeve body. The liner includes the step of machining the unmachined surface after performing the securing step to provide a machined surface providing a portion of the plunger surface.

In a further embodiment of any of the above, the method includes the step of providing cooling holes in the shot sleeve body configured to be in fluid communication with a cooling fluid source. At least one cooling hole is arranged beneath the liner.

In a further embodiment of any of the above, at least one cooling hole includes a cooling channel that is in fluid communication with a backside of the liner.

In a further embodiment of any of the above, the shot sleeve body and the liner are provided by first and second materials that are different than one another.

In a further embodiment of any of the above, the method includes the step of removing a worn liner and performing the securing step to provide a replacement liner.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible.

DETAILED DESCRIPTION

Figure 1:
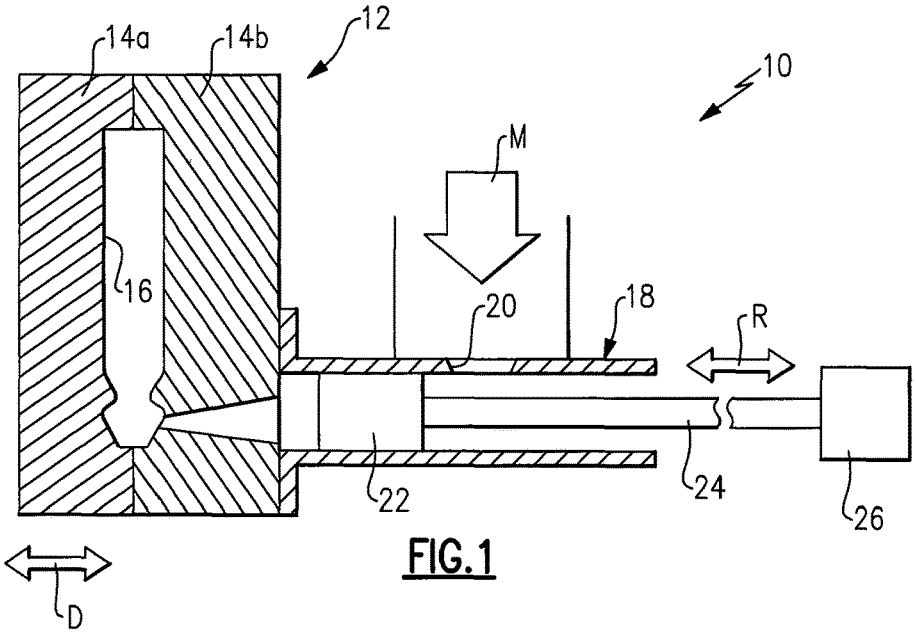
FIG. 1 is a schematic view of an example die casting machine.

A die casting machine 10 is schematically illustrated in FIG. 1. The machine 10 includes a die 12 having multiple die portions 14A, 14B that cooperate with one another to provide a part shape 16. The die 12 is exemplary only and may have any suitable configuration depending on the application.

A shot sleeve 18 is in fluid communication with the die 12 to force molten metal into the die 12 during the die casting process. The shot sleeve 18 includes a pour opening 20 that receives molten material M. A plunger 22 is retracted by an actuator 26 via a rod 24 such that molten metal may be received in an area in the shot sleeve 18 immediately beneath the pour opening 20 and left of the retracted plunger 22. The plunger 22 is moved axially along a plunger axis R to the position illustrated in FIG. 1 to force the molten metal into the die 12. Once the molten metal has sufficiently solidified within the die 12, the die portions 14A, 14B are separated in the direction D.

Figure 2:
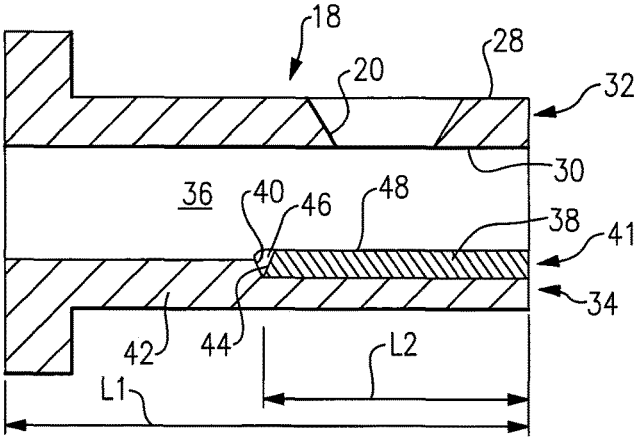
FIG. 2 is a schematic view of an example shot sleeve having a liner.

One example shot sleeve 18 is shown in more detail in FIG. 2. The shot sleeve 18 includes a shot sleeve body 42 constructed from a first material. The shot sleeve body 42 includes an outer diameter 28 radially spaced from an inner diameter 30 that provides a cavity 36. The pour opening 20 extends through the shot sleeve 18 to fluidly communicate the molten material M into the cavity 36. The pour opening 20 is arranged on a first or upper side 32 of the shot sleeve 18, and the molten material accumulates on a second or lower side 34 when the shot sleeve is filled.

A liner 38 is secured at the shot sleeve body 42 immediately beneath the pour opening 20. The liner 38 is constructed from a second material that may be different than the first material, if desired. The shot sleeve body 42 and the liner 38 together provide a plunger surface 51 (FIG. 3) that defines the cavity 36. The plunger 22 rides along the plunger surface 51 during the casting operation.

The type of materials used depends upon a variety of factors. In one example, the first material may be a relatively expensive material, and the second material may be a cheaper material that can be removed and replaced during routine maintenance. In another example, an expensive refractory material can be used for the liner, which can last longer in the area beneath the pour opening.

In one example, a pocket 41 is provided in the shot sleeve body 42. The liner 38 includes a perimeter 44 that is secured to an edge 40 of the pocket 41 by, for example, a weld bead 46. In one example, the liner 38 provides an unmachined surface 48 that is proud of the adjacent surface provided by the shot sleeve body 42, as shown in FIG. 2. Once the liner 38 is secured to the shot sleeve body 42, the liner 38 is machined to provide a machined surface 50 that is flush with the surrounding shot sleeve body 42 to provide a smooth, uninterrupted plunger surface 51.

Figure 3:
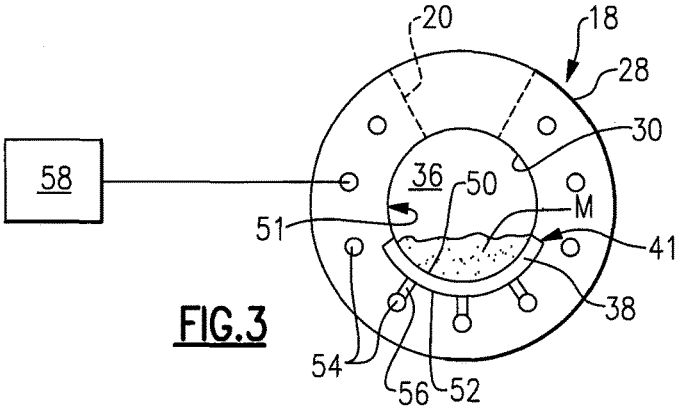
FIG. 3 is a schematic end view of the shot sleeve illustrated in FIG. 2 with the liner machined.

Referring to FIG. 2, the shot sleeve body 42 extends a first axial length L1. The liner 38 extends a second axial length L2 that is less than the first axial length L1. As shown in FIG. 3, the plunger surface 51 is circular and circumscribes the cavity 36. The liner 38 is arcuate in shape and extends to at least a level of a shot of molten material in one example.

The shot sleeve body 42 can be constructed from any material, such as steel or tungsten. In one example, the liner 38 is provided by a tungsten material having a lower tungsten content than that of the shot sleeve body 42, which reduces cost. Alternatively, the liner may be constructed from tantalum.

As shown in FIG. 3, the shot sleeve 18 includes cooling holes 54 in fluid communication with a cooling fluid source 58. The cooling holes 54 may include cooling panels 56 and fluid communication with a backside 52 of the liner 38. Providing cooling fluid beneath the liner 38 may promote and improve temperature control of the shot sleeve 18. The cooling channels 56 may further enhance the evenness of the temperature distribution of the shot sleeve 18.

The shot sleeve 18 is manufactured by providing the shot sleeve body 42. The liner 38 is secured to the shot sleeve body 42 within the cavity 36 and the pour opening 20. The shot sleeve body 42 and the liner 38 together provide the plunger surface 51. In one example, a securing step during manufacturing includes welding a liner 38 to the shot sleeve body 42, for example, by plasma or laser welding. The liner 38 can be machined along with the inner diameter of the shot sleeve body 42, if desired, to provide the machined surface 50 which provides a portion of the plunger surface 51.

Once the liner 38 has been worn, the liner 38 can be machined and a new liner welded to the shot sleeve body 42. As a result, the entire shot sleeve 18 need not be discarded, which is especially desirable if, for example, high cost materials such as refractory tungsten is used for the shot sleeve body 42.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that mason, the following claims should be studied to determine their true scope and content.

What is claimed is:

1. A shot sleeve for a die casting machine, comprising:

a shot sleeve body with a pour opening extending to spaced apart inner and outer diameters, the shot sleeve body is a first material; and a liner is secured to the shot sleeve body beneath the pour opening, the liner is a second material, the shot sleeve body and the liner together providing a plunger surface defining a cavity configured to receive a molten shot of material, wherein the liner is received within a pocket in the shot sleeve body defined by an edge, and the liner includes a perimeter secured to the edge by a weld, wherein the liner and the weld includes a machined surface providing a portion of the plunger surface.

2. The shot sleeve according to claim 1, wherein the shot sleeve body extends a first axial length, and the liner extends a second axial length that is less than the first axial length.

3. The shot sleeve according to claim 1, wherein the plunger surface is circular and circumscribes the cavity, and the liner is arcuate in shape.

4. The shot sleeve according to claim 3, wherein the liner is configured to extend at least to a level of a shot of molten material.

5. The shot sleeve according to claim 1, wherein the shot sleeve body includes cooling holes configured to be in fluid communication with a cooling fluid source, at least one cooling hole arranged beneath the liner.

6. The shot sleeve according to claim 5, wherein the at least one cooling hole includes a cooling channel in fluid communication with a backside of the liner.

7. The shot sleeve according to claim 1, wherein the first and second materials are different than one another.

8. The method according to claim 1, comprising the step of providing cooling holes in the shot sleeve body configured to be in fluid communication with a cooling fluid source, at least one cooling hole arranged beneath the liner.

9. The method according to claim 8, wherein the at least one cooling hole includes a cooling channel in fluid communication with a backside of the liner.

10. A method of manufacturing a shot sleeve, comprising the steps of:

providing a shot sleeve body with a pour opening in fluid communication with a cavity configured to receive a molten shot of material;

arranging a liner within a pocket provided in the shot sleeve body, wherein the liner includes an unmachined surface proud of shot sleeve body;

securing the liner to the shot sleeve body within the cavity and beneath the pour opening, the liner, the shot sleeve body and the liner together providing a plunger surface, wherein the securing step includes welding a perimeter of the liner to an edge of the pocket; and machining the unmachined surface after performing the securing step to provide a machined surface providing a portion of the plunger surface.

11. The method according to claim 10, wherein the shot sleeve body extends a first axial length, and the liner extends a second axial length that is less than the first axial length.

12. The method according to claim 10, wherein the plunger surface is circular and circumscribes the cavity, and the liner is arcuate in shape.

13. The method according to claim 12, wherein the liner is configured to extend at least to a level of a shot of molten material.

14. The method according to claim 10, wherein the shot sleeve body and the liner are provided by first and second materials that are different than one another.

15. The method according to claim 10, comprising the step of removing a worn liner and performing the securing step to provide a replacement liner.

* * * * *